US010140903B2

(12) United States Patent
Lee et al.

(10) Patent No.: US 10,140,903 B2
(45) Date of Patent: Nov. 27, 2018

(54) ARRAY SUBSTRATE AND DRIVING METHOD THEREOF, DISPLAY PANEL AND DISPLAY DEVICE

(71) Applicant: BOE TECHNOLOGY GROUP CO., LTD., Beijing (CN)

(72) Inventors: Chungchun Lee, Beijing (CN); Liye Duan, Beijing (CN); Yanzhao Li, Beijing (CN); Chunwei Wu, Beijing (CN); Hanjun Park, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 98 days.

(21) Appl. No.: 14/785,709

(22) PCT Filed: Apr. 20, 2015

(86) PCT No.: PCT/CN2015/076950

§ 371 (c)(1),
(2) Date: Oct. 20, 2015

(87) PCT Pub. No.: WO2016/082438

PCT Pub. Date: Jun. 2, 2016

(65) Prior Publication Data

US 2016/0335937 A1 Nov. 17, 2016

(30) Foreign Application Priority Data

Nov. 28, 2014 (CN) ..... 2014 1 0710892

(51) Int. Cl.
*G09G 3/20* (2006.01)
*G09G 3/3233* (2016.01)

(52) U.S. Cl.
CPC ..... *G09G 3/2003* (2013.01); *G09G 3/2074* (2013.01); *G09G 3/3233* (2013.01);
(Continued)

(58) Field of Classification Search
CPC ..... G09G 3/2003; G09G 2340/06; G09G 2300/0426; G09G 3/2074; H01L 27/3218
See application file for complete search history.

(56) References Cited

U.S. PATENT DOCUMENTS 7,492,379 B2 2/2009 Credelle et al.
7,567,617 B2 7/2009 Holcomb
(Continued)

FOREIGN PATENT DOCUMENTS

CN 101923826 A 12/2010
CN 102354701 A 2/2012
(Continued)

OTHER PUBLICATIONS

International Search Report dated Aug. 19, 2015 corresponding to International application No. PCT/CN2015/076950.
(Continued)

*Primary Examiner* — Priyank J Shah
(74) *Attorney, Agent, or Firm* — Nath, Goldberg & Meyer; Joshua B. Goldberg; Daniel Bissing

(57) ABSTRACT

The invention provides an array substrate and a driving method thereof, a display panel and a display device. The array substrate comprises a plurality of circulating units and a plurality of pixel circuits. Each circulating unit consists of four sub-pixel units located in four columns and two rows, sub-pixel units in any two adjacent columns are located in different rows and have different colors, and sub-pixel units in at least one row have different colors. Each sub-pixel unit is connected to one pixel circuit, and each sub-pixel unit comprises a first sub-pixel and a second sub-pixel located in the same column and having the same color. The pixel circuit is configured to drive the first sub-pixel when a first frame picture is displayed, and to drive the second sub-pixel when a second frame picture is displayed.

16 Claims, 2 Drawing Sheets

(52) U.S. Cl.
CPC ..... *G09G 2300/0426* (2013.01); *G09G 2300/0443* (2013.01); *G09G 2300/0452* (2013.01); *G09G 2300/0465* (2013.01); *G09G 2300/0804* (2013.01); *G09G 2300/0814* (2013.01); *G09G 2300/0852* (2013.01); *G09G 2300/0861* (2013.01); *G09G 2310/0251* (2013.01); *G09G 2340/0457* (2013.01)

(56) References Cited

U.S. PATENT DOCUMENTS 9,129,923 B1* 9/2015 Han ..... H01L 27/3248
9,734,763 B2* 8/2017 Sun ..... G09G 3/2074
2002/0196389 A1* 12/2002 Koyama ..... G09G 3/3275 349/69
2005/0062692 A1* 3/2005 Lo ..... G09G 3/325 345/76
2006/0103940 A1 5/2006 Lo et al.
2008/0117154 A1 5/2008 Yeh
2011/0221789 A1* 9/2011 Ota ..... H01L 27/3267 345/690
2012/0147065 A1* 6/2012 Byun ..... G09G 3/3208 345/690
2014/0009456 A1* 1/2014 Kim ..... G09G 3/3208 345/212
2014/0198479 A1* 7/2014 Chao ..... H01L 27/3218 362/84
2015/0009194 A1* 1/2015 Kim ..... G09G 3/3233 345/211
2015/0015468 A1* 1/2015 Ko ..... G09G 3/3233 345/82
2015/0116383 A1* 4/2015 Kim ..... G09G 3/3258 345/694
2015/0130868 A1* 5/2015 Feng ..... G09G 3/2003 345/694
2015/0187277 A1* 7/2015 Maeyama ..... G09G 3/3291 345/694
2015/0213761 A1* 7/2015 Chen ..... G09G 3/3258 345/77
2015/0302814 A1* 10/2015 Shiomi ..... G09G 3/3607 345/694
2016/0155385 A1* 6/2016 Yang ..... G09G 3/3233 345/174
2016/0180774 A1* 6/2016 Yang ..... G09G 3/3233 345/214
2016/0204165 A1* 7/2016 Yang ..... H01L 27/323 345/174
2016/0224157 A1* 8/2016 Yang ..... G09G 3/3233
2016/0247447 A1* 8/2016 Yang ..... G09G 3/3233
2016/0253963 A1* 9/2016 Yang ..... G09G 3/3225 345/211
2016/0253972 A1* 9/2016 Bai ..... G09G 3/3208 345/690

FOREIGN PATENT DOCUMENTS

CN 103745684 A 4/2014
CN 103777393 A 5/2014
CN 103903524 A 7/2014
CN 103904105 A 7/2014
CN 104134426 A 11/2014
CN 104361862 A 2/2015

OTHER PUBLICATIONS

First Office Action dated Mar. 25, 2016 corresponding Chinese application No. 201410710892.4.
European extended search report dated Jun. 8, 2018 for corresponding application No. 15778188.1.
Mexican office action dated Apr. 2, 2018 for corresponding application No. MX/a/2015/017977 with English translation attached.

* cited by examiner

ARRAY SUBSTRATE AND DRIVING METHOD THEREOF, DISPLAY PANEL AND DISPLAY DEVICE

This is a National Phase Application filed under 35 U.S.C. 371 as a national stage of PCT/CN 2015/076950 filed on Apr. 20, 2015, an application claiming the benefit under Chinese Application No. 201410710892.4 filed on Nov. 28, 2014, the content of each of which is hereby incorporated by reference in its entirety.

TECHNICAL FIELD

The invention relates to the field of display technology, and in particular to an array substrate and a driving method thereof, a display panel and a display device.

BACKGROUND

With the development of technology, the resolution of a display panel is higher and higher. That is, the number of pixels in the unit area is increasing, which requires that size of each sub-pixel is becoming smaller and smaller. However, due to process constraints, apparently, the size of each sub-pixel cannot be decreased unlimitedly.

In order to improve the display effect under a given size of the sub-pixel, a display device in the Pentile mode is proposed. In the display device in the Pentile mode, sub-pixels of certain colors (such as red sub-pixels and blue sub-pixels) are decreased in number while sub-pixels of different colors in the display device are virtually considered to be in different "layers", and each layer is divided into a plurality of sampling regions, sampling regions in different layers are divided so that they are not overlapped with each other, and then content to be displayed by each sub-pixel is calculated by area ratio of the sampling regions. A part of sub-pixels in the display device in the Pentile mode are shared, so that the visual resolution is higher than the actual physical resolution. That is to say, compared to a conventional display panel, the display panel in the Pentile mode may have more pixel units formed thereon. However, as understood by persons skilled in the art, each pixel unit requires to be driven by one pixel circuit, and due to the limitation on the size of the display panel, although more pixel units may be fabricated, there is no way to fabricate more pixel circuits accordingly, thus it is still very difficult to fabricate a high resolution display panel.

SUMMARY OF THE INVENTION

In order to solve the above problems existing in the current display panels, embodiments of the invention provide a high resolution array substrate and a driving method thereof, a display panel and a display device.

According to an embodiment of the invention, an array substrate is provided to comprise a plurality of circulating units and a plurality of pixel circuits. Each circulating unit consists of four sub-pixel units located in four columns and two rows, sub-pixel units in any two adjacent columns are located in different rows and have different colors, and sub-pixel units in at least one row have different colors. Each sub-pixel unit is connected to one pixel circuit, each sub-pixel unit comprises a first sub-pixel and a second sub-pixel located in the same column and having the same color. The pixel circuit is configured to drive the first sub-pixel when a first frame picture is displayed, and to drive the second sub-pixel when a second frame picture is displayed.

The circulating unit may comprise one red sub-pixel unit, one blue sub-pixel unit and two green sub-pixel units.

The circulating unit may comprise one red sub-pixel unit, one green sub-pixel unit, one blue sub-pixel unit and one white sub-pixel unit.

The pixel circuit may comprise a first sub-pixel circuit, a second sub-pixel circuit and a control unit. The first sub-pixel circuit is connected to the first sub-pixel, and the second sub-pixel circuit is connected to the second sub-pixel. The control unit is configured to control the first sub-pixel circuit to drive the first sub-pixel when the first frame picture is displayed, and to control the second sub-pixel circuit to drive the second sub-pixel when the second frame picture is displayed.

The array substrate may further comprise a plurality of data lines, and the first sub-pixel circuit and the second sub-pixel in each of the pixel circuits are connected to the same data line.

The pixel circuit may further comprise a compensation circuit, the first sub-pixel circuit may at least comprise a first driving transistor, and the second sub-pixel circuit may at least comprise a second driving transistor. The compensation circuit is configured to compensate for a threshold voltage of the first driving transistor in the first sub-pixel circuit, and to compensate for a threshold voltage of the second driving transistor in the second sub-pixel circuit.

According to embodiments of the invention, a driving method of the above array substrate is provided. The driving method comprises: driving, by the pixel circuit, the first sub-pixel in the sub-pixel unit connected to the pixel circuit when a first frame picture is displayed; and driving, by the pixel circuit, the second sub-pixel in the sub-pixel unit connected to the pixel circuit when a second frame picture is displayed.

According to embodiments of the invention, a display panel is provided to comprise the above array substrate.

According to embodiments of the invention, a display device is provided to comprise the above display panel.

In the array substrate of the embodiments of the invention, the first sub-pixel and the second sub-pixel in each sub-pixel unit are driven by the same pixel circuit, and compared to the prior art in which it is required to drive the first sub-pixel and the second sub-pixel in each sub-pixel unit using two pixel circuits, respectively, the number of the pixel circuits required in the entire array substrate is reduced, thus decreasing production cost and process pressure. At the same time, since the number of the pixel circuits is reduced, more sub-pixel units can be formed per unit area on the array substrate, thus effectively increasing resolution of the array substrate.

DETAILED DESCRIPTION OF EMBODIMENTS

In order to make persons skilled in the art better understand the technical solutions of the invention, the invention will be further described in detail below in connection with the drawings and the implementations.

Figure 1:
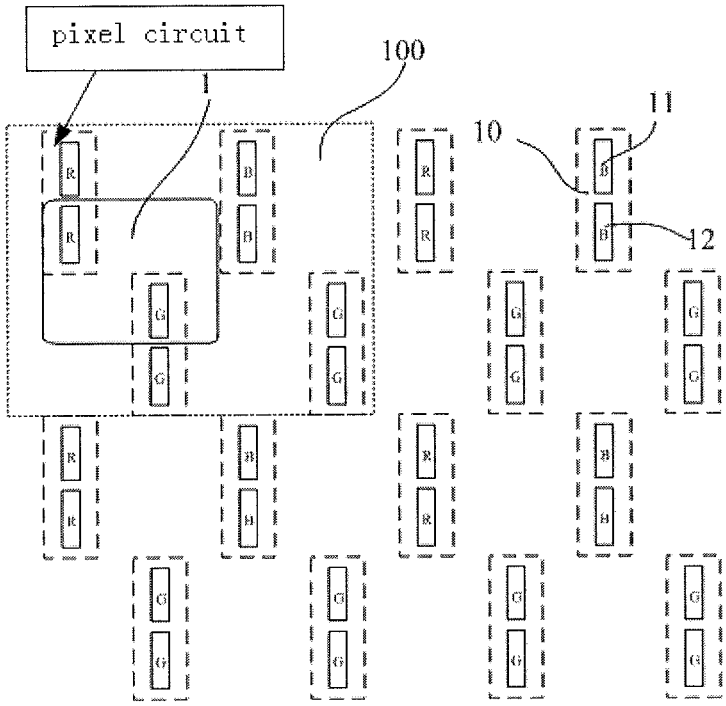
FIG. 1 is a schematic view of an array substrate according to an embodiment of the invention.
Figure 2:
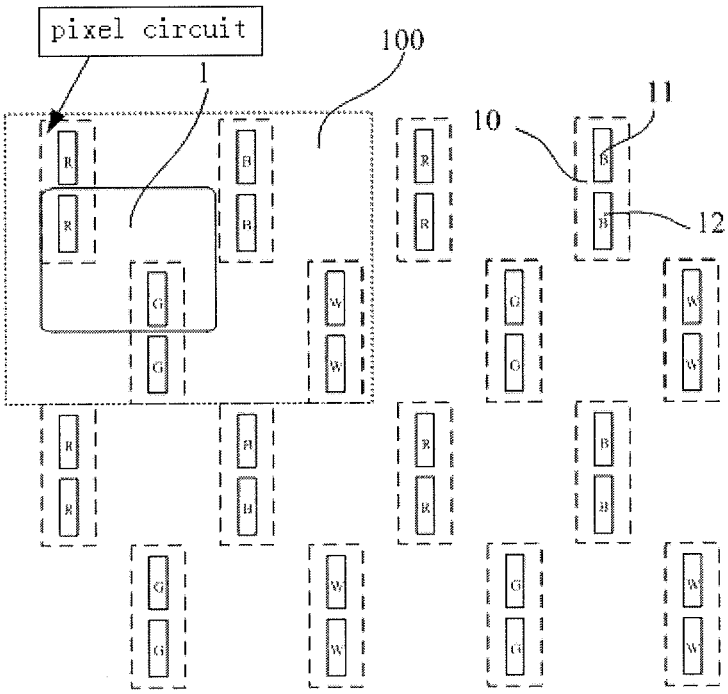
FIG. 2 is a schematic view of another array substrate according to an embodiment of the invention.

In connection with FIGS. 1 and 2, the embodiment of the invention provides an array substrate, which comprises a plurality of circulating units 100, each circulating unit 100 consists of four sub-pixel units 10 located in four columns and two rows, sub-pixel units 10 in every two adjacent columns are located in different rows and have different colors, and sub-pixel units 10 in at least one row have different colors. The array substrate further comprises a plurality of pixel circuits, each sub-pixel unit 10 is connected to one pixel circuit, each sub-pixel unit 10 comprises a first sub-pixel 11 and a second sub-pixel 12 located in the same column and having the same color. Each pixel circuit is configured to drive the first sub-pixel 11 when a first frame picture is displayed, and to drive the second sub-pixel 12 when a second frame picture is displayed.

In addition, a pixel unit 1 may comprise two sub-pixels, which are from two sub-pixel units 10 located in two adjacent columns, and the two sub-pixels are located in two adjacent rows.

It should be pointed out that, in order to achieve a high resolution display in the prior art, it is required to make the size of each sub-pixel smaller and smaller; however, due to process constraints, apparently, the size of the sub-pixel cannot be reduced unlimitedly. Thus, 2-in-1 technology, that is, two adjacent sub-pixels of the same color in the display panel share an opening in the FMM (Fine Metal Shadow Mask) is introduced in the invention, that is to say, in the embodiment, driving of the first sub-pixel 11 and the second sub-pixel 12 of each sub-pixel unit 10 when different frame pictures are displayed is achieved by one opening in the FMM. At the same time, since the respective pixel units 1 in the array substrate of the embodiment are arranged in the above manner, a high resolution display is achieved with less sub-pixels in a specific pixel sharing manner. For example, one pixel unit 1 in the embodiment may be only provided with two sub-pixels, a red sub-pixel R and a green sub-pixel G, and a blue sub-pixel B in an adjacent pixel unit 1 may be used to perform a normal display, so that more pixel units 1 can be fabricated per unit area on the array substrate, thus increasing the resolution of the array substrate.

In the embodiment, the first sub-pixel 11 and the second sub-pixel 12 of each sub-pixel unit 10 are driven by the same pixel circuit, and compared to the prior art in which it is required to drive the first sub-pixel 11 and the second sub-pixel 12 in each sub-pixel unit 10 using two pixel circuits, respectively, the number of the pixel circuits required in the entire array substrate is reduced, thus decreasing production cost and process pressure. At the same time, since the number of the pixel circuits is reduced, more sub-pixel units 10 can be formed per unit area on the array substrate, thus effectively increasing resolution of the array substrate.

As shown in FIG. 1, as a preferable implementation of the embodiment, one circulating unit 100 of the array substrate comprises four sub-pixel units 10, that is, one red sub-pixel unit, one blue sub-pixel unit, and two green sub-pixel units.

In particular, red sub-pixel units 10 and blue sub-pixel units 10 in odd rows are alternately arranged, and all sub-pixel units arranged in even rows are green. Alternatively, all sub-pixel units 10 arranged in odd rows are green, and red sub-pixel units 10 and blue sub-pixel units 10 are alternately arranged in even rows. The red sub-pixel unit 10 comprises a first red sub-pixel R and a second red sub-pixel R, the blue sub-pixel unit 10 comprises a first blue sub-pixel B and a second blue sub-pixel B, and the green sub-pixel unit 10 comprises a first green sub-pixel G and a second green sub-pixel G. When a first frame picture is displayed, each pixel circuit drives a first sub-pixel 11 of a sub-pixel unit 10 connected to the pixel circuit, when a second frame picture is displayed, the pixel circuit drives a second sub-pixel 12 of the sub-pixel unit 10 connected to the pixel circuit, and this time-sharing driving method can improve the resolution of the array substrate.

As shown in FIG. 2, as another preferable implementation of the embodiment, the circulating unit 100 comprises one red sub-pixel unit 10, one green sub-pixel unit 10, one blue sub-pixel unit 10 and one white sub-pixel unit 10. In this implementation, only the colors of the sub-pixels are different from those in the above implementation, and the driving method and the display principle are the same as those in the above implementation, which will not be described in detail here.

The pixel circuit in the embodiment may comprise a first sub-pixel circuit, a second sub-pixel circuit, and a control unit. The first sub-pixel circuit is connected to a first sub-pixel 11, the second sub-pixel circuit is connected to a second sub-pixel, and the control unit is configured to control the first sub-pixel circuit to drive the first sub-pixel 11 when a first frame picture is displayed, and to control the second sub-pixel circuit to drive the second sub-pixel 12 when a second frame picture is displayed.

Furthermore, the array substrate further comprises a plurality of data lines Data, and the first sub-pixel circuit and the second sub-pixel circuit of each of the pixel circuits are connected to the same data line Data. Thus, the structure of the array substrate may be simple.

Moreover, the pixel circuit of the embodiment may further comprise a compensation circuit. The first sub-pixel circuit at least comprises a first driving transistor, and the second sub-pixel circuit at least comprises a second driving transistor. The compensation circuit is configured to compensate for a threshold voltage of the first driving transistor in the first sub-pixel circuit, and to compensate for a threshold voltage of the second driving transistor in the second sub-pixel circuit. The two sub-pixel circuits share one compensation unit so that the threshold voltages of the driving transistors are compensated to improve the display effect, decrease the occupation area of the pixel circuits on the array substrate, and reduce the cost.

Accordingly, the embodiment further provides a driving method of any one of the above array substrates, which comprises: driving, by a pixel circuit, a first sub-pixel 11 in a sub-pixel unit 10 connected to the pixel circuit when a first frame picture is displayed; and driving, by the pixel circuit, a second sub-pixel 12 in the sub-pixel unit 10 connected to the pixel circuit when a second frame picture is displayed.

Figure 3:
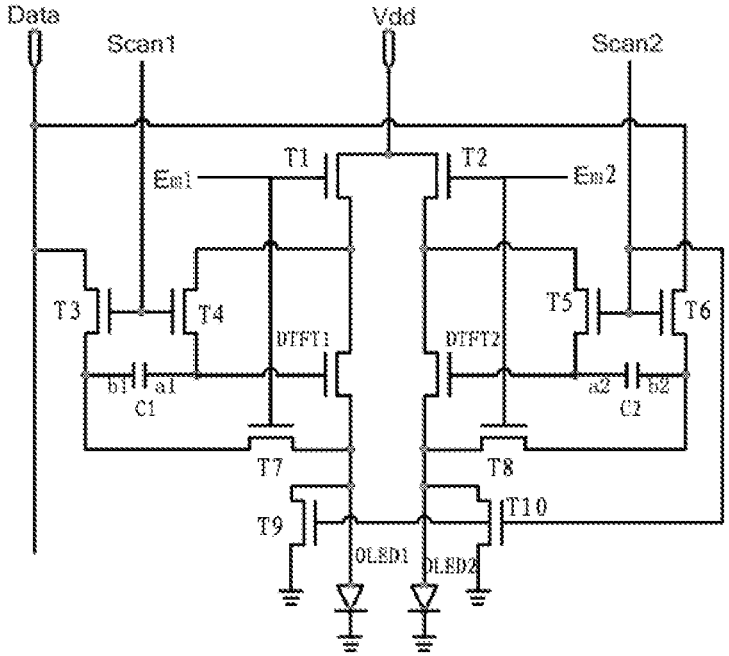
FIG. 3 is a principle view of a pixel circuit according to an embodiment of the invention.

As a structure of a pixel circuit in the embodiment, as shown in FIG. 3, each pixel circuit comprises a first sub-pixel circuit and a second sub-pixel circuit, the first sub-pixel circuit comprises a first driving transistor DTFT1 and the second sub-pixel circuit comprises a second driving transistor DTFT2. In FIG. 3, a first display device OLED1 is equivalent to the first sub-pixel, and a second display device OLED2 is equivalent to the second sub-pixel. The first sub-pixel circuit and the second sub-pixel circuit share the compensation unit, and controlled by the same data line Data, which is connected to the control unit. The compensation unit is configured to adjust a gate voltage of the first driving transistor DTFT1 in the first sub-pixel circuit to eliminate the influence of the threshold voltage of the first driving transistor DTFT1 on the driving current of the first display device OLED1, and to adjust a gate voltage of the second driving transistor DTFT2 in the second sub-pixel circuit to eliminate the influence of the threshold voltage of the second driving transistor DTFT2 on the driving current of the second display device OLED2. The compensation unit may particularly comprise a first switching transistor T1, a second switching transistor T2, a third switching transistor T3, a fourth switching transistor T4, a fifth switching transistor T5, a sixth switching transistor T6, a seventh switching transistor T7, an eighth switching transistor T8, a ninth switching transistor T9, a tenth switching transistor T10, a first storage capacitor C1 and a second storage capacitor C2. A gate of the first switching transistor T1 and a gate of the seventh switching transistor T7 are connected to a first light emitting control line Em1, a source of the first switching transistor T1 is connected to a source of the second switching transistor T2 and a first reference voltage source VDD, and a drain of the first switching transistor T1 is connected to a source of the fourth switching transistor T4 and a source of the first driving transistor DTFT1. A gate of the second switching transistor T2 is connected to a gate of the eighth switching transistor T8 and a second light emitting control line Em2, and a drain of the second switching transistor T2 is connected to a source of the fifth switching transistor T5 and a source of the second switching transistor DTFT2. A gate of the third switching transistor T3 is connected to a gate of the fourth switching transistor T4 and a first scanning line San1, a source of the third switching transistor T3 is connected to the data line Data, a drain of the third switching transistor T3 is connected to a second terminal b1 of the first storage capacitor C1 and a source of the seventh switching transistor T7. A drain of the fourth switching transistor T4 is connected to a first terminal a1 of the first storage capacitor C1 and a gate of the first driving transistor DTFT1. A gate of the fifth switching transistor T5 is connected to a gate of the sixth switching transistor T6 and the second scanning line Scan2, and a drain of the fifth switching transistor T5 is connected to a first terminal a2 of the second storage capacitor C2 and a gate of the second driving transistor DTFT2. A source of the sixth switching transistor T6 is connected to the data line Data, a drain of the sixth switching transistor T6 is connected to a second terminal b2 of the second storage capacitor C2 and a source of the eighth switching transistor T8. A drain of the seventh switching transistor T7 is connected to a source of the ninth switching transistor T9, a drain of the first driving transistor DTFT1 and a first terminal of the first display device, and a second terminal of the first display device is grounded. A drain of the eighth switching transistor T8 is connected to a source of the tenth switching transistor T10, a drain of the second driving transistor DTFT2 and a first terminal of the second display device, and a second terminal of the second display device is grounded. A gate of the ninth switching transistor T9 is connected to a gate of the tenth switching transistor T10 and the second scanning line Scan2, and a drain of the ninth switching transistor T9 is grounded. A drain of the tenth switching transistor T10 is grounded.

In order to make the pixel circuit have better performance so that each pixel unit can be well controlled, the first switching transistor T1, the second switching transistor T2, the third switching transistor T3, the fourth switching transistor T4, the fifth switching transistor T5, the sixth switching transistor T6, the seventh switching transistor T7, the eighth switching transistor T8, the ninth switching transistor T9, the tenth switching transistor T10, the first driving transistor DTFT1 and the second driving transistor DTFT2 are all N-type thin film transistors.

Figure 4:
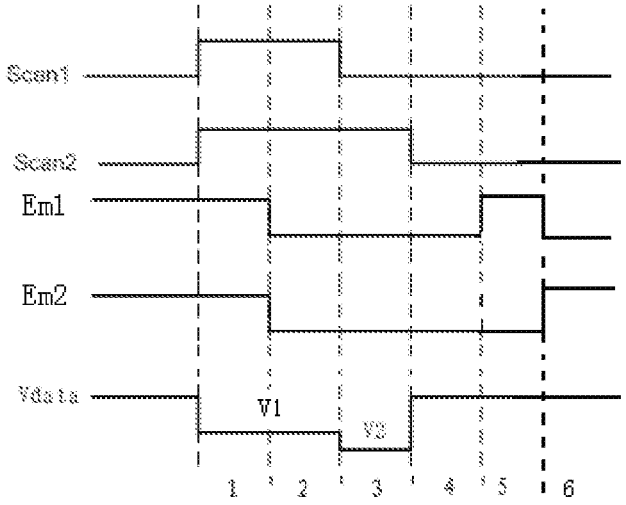
FIG. 4 is a timing chart of operation of the pixel circuit in FIG. 3.

In connection with FIGS. 3 and 4, a driving method of the pixel circuit is further provided in this embodiment, and the driving method particularly comprises the following six time periods from a first time period to a sixth time period.

Reset stage (a first time period): a high level signal is inputted in the first scanning line Scan1, the second scanning line Scan2, the first light emitting control line Em1 and the second light emitting control line Em2. The first switching transistor T1, the second switching transistor T2, the third switching transistor T3, the fourth switching transistor T4, the fifth switching transistor T5, the sixth switching transistor T6, the seventh switching transistor T7, the eighth switching transistor T8, the ninth switching transistor T9 and the tenth switching transistor T10 are all turned on, and the first reference voltage source sets a potential at the first terminal a1 of the first storage capacitor C1 and a potential at the first terminal a2 of the second storage capacitor C2 to be voltage Vdd of the first reference voltage source and supplies a first voltage V1 to the data line Data. At this time, since the third switching transistor T3, the fourth switching transistor T4, the fifth switching transistor T5 and the sixth switching transistor T6 are all turned on, both a potential at the second terminal b1 of the first storage capacitor C1 and a potential at the second terminal b2 of the second storage capacitor C2 are set to be the first voltage V1, that is, a1=Vdd, b1=V1, a2=Vdd, and b2=V1.

Discharge stage (a second time period): a high level signal is inputted in the first scanning line Scan1 and the second scanning line Scan2, and a low level signal is inputted in the first light emitting control line Em1 and the second light emitting control line Em2. The third switching transistor T3, the fourth switching transistor T4, the fifth switching transistor T5, the sixth switching transistor T6, the ninth switching transistor T9, and the tenth switching transistor T10 are all turned on, both the first storage capacitor C1 and the second storage capacitor C2 discharge, and the potential at the first terminal a1 of the first storage capacitor C1 and the potential at the first terminal a2 of the second storage capacitor C2 are discharged to be a threshold voltage Vth1 of the first driving transistor DTFT1 and a threshold voltage Vth2 of the second driving transistor DTFT2. In addition, since the ninth switching transistor T9 and the tenth switching transistor T10 are turned on, current in the circuit will not flow through the first display device OLED1 and the second display device OLED2, indirectly reducing power consumption of the first display device OLED1 and the second display device OLED2.

Continuous discharge stage (a third time period): a low level signal is inputted in the first scanning line Scan1, the first light emitting control line Em1 and the second light emitting control line Em2, a high level signal is inputted in the second scanning line Scan2, and a second voltage V2 is supplied to the data line Data. At this time, the potential at the second terminal b2 of the second storage capacitor C2 accordingly becomes V2, and the potential at the first terminal a2 of the second storage capacitor C2 is maintained at Vth2, so that a voltage difference between the two terminals of the first storage capacitor C1 is Vth1−V1, and a voltage difference between the two terminals of the second storage capacitor C2 is Vth2−V2, wherein V1>V2.

Voltage stabilization stage (a fourth time period): a low level signal is inputted in the first scanning line Scan1, the second scanning line Scan2, the first light emitting control line Em1 and the second light emitting control line Em2. The first switching transistor T1, the second switching transistor T2, the third switching transistor T3, the fourth switching transistor T4, the fifth switching transistor T5, the sixth switching transistor T6, the seventh switching transistor T7, the eighth switching transistor T8, the ninth switching transistor T9 and the tenth switching transistor T10 are all turned off, and the voltage differences between the two terminals of the first storage capacitor C1 and the second storage capacitor C2 are stabilized, both of which are preparing for the light emitting stage.

First light emitting stage (a fifth time period): a low level signal is inputted in the first scanning line Scan1 and the second scanning line Scan2, and a high level signal is inputted in the first light emitting control line Em1, and a low level signal is inputted in the second light emitting control line Em2. The first switching transistor T1 and the seventh switching transistor T7 are turned on, the potential V1 at the second terminal b1 of the first storage capacitor C1 becomes an anode potential Voled1 of the first display device OLED1, the potential at the first terminal a1 of the first storage capacitor C1 is Vth1−V1+Voled1, and the first driving transistor DTFT1 drives the first display device OLED1 to emit light. At this time, a current flowing through the first display device OLED1 may be obtained based on a saturation current of the thin film transistor:

$$\begin{aligned} loled1 &= K(VGS - Vth1)^2 \\ &= K[(Vth1 - V1 + Voled1) - Voled1 - Vth1]^2 \\ &= K \cdot (V1)^2 \end{aligned}$$

Second light emitting stage (a sixth time period): a low level signal is inputted in the first scanning line Scan1 and the second scanning line Scan2, a low level signal is inputted in the first light emitting control line Em1, and a high level signal is inputted in the second light emitting control line Em2. At this time, the second switching transistor T2 and the eighth switching transistor T8 are turned on, the potential V2 at the second terminal b2 of the second storage capacitor C2 becomes an anode potential Voled2 of the second display device OLED2, the potential at the first terminal a2 of the second storage capacitor C2 becomes Vth2−V2+Voled2, and the second driving transistor DTFT2 drives the second display device OLED2 to emit light. With the same principle, the current flowing through the second display device OLED2 is loled2=K·(V2)$^2$.

Based on the above obtained currents of the first display device OLED1 and the second display device OLED2, the pixel circuit not only achieves a high resolution display, but also avoids the influence of the threshold voltage of the driving transistor on the pixel circuit, so that the array substrate of the embodiment obtains a more uniform display.

It should be pointed out that, the method for driving respective sub-pixels on the array substrate in the embodiment is described only taking the above pixel circuit as an example. However, the pixel circuit in the embodiment is not limited to the above pixel circuit. Any pixel circuit which can achieve the time-sharing driving method can be applied to the array substrate of the embodiment, and falls within the protection scope of the embodiment.

Accordingly, the embodiment further provides a display panel, which comprises the above array substrate, and thus can achieve a high resolution display.

Accordingly, the embodiment further provides a display device, which comprises the above display panel, and may be any product or component having a display function such as a liquid crystal panel, an OLED panel, a mobile phone, a tablet computer, a TV, a display, a notebook computer, a digital photo frame, and a navigator.

Because the display device in the embodiment comprises the above display panel, so its resolution is higher, and its performance is better.

Of course, the display device in the embodiment may also comprise other conventional structures, such as the display driving unit, etc.

It should be understood that, the above embodiments are only exemplary embodiments employed to illustrate the principle of the invention, and the invention is not limited thereto. For ordinary persons skilled in the art, various variants and improvements can be made without departing from the spirit and substance of the invention, and these variants and improvements are also regarded as the protection scope of the invention.

The invention claimed is:

1. An array substrate, comprising a plurality of circulating units and a plurality of pixel circuits, wherein each circulating unit consists of four sub-pixel units located in four columns and two rows, sub-pixel units in any two adjacent columns are located in different rows and have different colors, and sub-pixel units in at least one row have different colors;

each sub-pixel unit comprises a first sub-pixel and a second sub-pixel located in the same column and having the same color, and both the first sub-pixel and the second sub-pixel are connected to a same pixel circuit; and the pixel circuit is configured to drive the first sub-pixel when a first frame picture is displayed, and to drive the second sub-pixel when a second frame picture is displayed, wherein each pixel circuit of the plurality of pixel circuits comprises a first sub-pixel circuit and a second sub-pixel circuit, the first sub-pixel circuit comprises a first driving transistor and the second sub-pixel circuit comprises a second driving transistor, the first sub-pixel circuit and the second sub-pixel circuit share a compensation unit, and are controlled by a same data line, which is connected to a control unit; the compensation unit is configured to adjust a gate voltage of the first driving transistor in the first sub-pixel circuit to eliminate influence of a threshold voltage of the first driving transistor on a driving current of the first sub-pixel, and to adjust a gate voltage of the second driving transistor in the second sub-pixel circuit to eliminate influence of a threshold voltage of the second driving transistor on a driving current of the second sub-pixel; the compensation unit comprises a first switching transistor, a second switching transistor, a third switching transistor, a fourth switching transistor, a fifth switching transistor, a sixth switching transistor, a seventh switching transistor, an eighth switching transistor, a ninth switching transistor, a tenth switching transistor, a first storage capacitor and a second storage capacitor; a gate of the first switching transistor and a gate of the seventh switching transistor are connected to a first light emitting control line, a source of the first switching transistor is connected to a source of the second switching transistor and a first reference voltage source, and a drain of the first switching transistor is connected to a source of the fourth switching transistor and a source of the first driving transistor; a gate of the second switching transistor is connected to a gate of the eighth switching transistor and a second light emitting control line, and a drain of the second switching transistor is connected to a source of the fifth switching transistor and a source of the second switching transistor; a gate of the third switching transistor is connected to a gate of the fourth switching transistor and a first scanning line, a source of the third switching transistor is connected to the data line, a drain of the third switching transistor is connected to a second terminal of the first storage capacitor and a source of the seventh switching transistor; a drain of the fourth switching transistor is connected to a first terminal of first storage capacitor and a gate of the first driving transistor; a gate of the fifth switching transistor is connected to a gate of the sixth switching transistor and a second scanning line, and a drain of the fifth switching transistor is connected to a first terminal of the second storage capacitor and a gate of the second driving transistor; a source of the sixth switching transistor is connected to the data line, a drain of the sixth switching transistor is connected to a second terminal of the second storage capacitor and a source of the eighth switching transistor; a drain of the seventh switching transistor is connected to a source of the ninth switching transistor, a drain of the first driving transistor and a first terminal of the first sub-pixel, and a second terminal of the first sub-pixel is grounded; a drain of the eighth switching transistor is connected to a source of the tenth switching transistor, a drain of the second driving transistor and a first terminal of the second sub-pixel, and a second terminal of the second is sub-pixel is grounded; a gate of the ninth switching transistor is connected to a gate of the tenth switching transistor and the second scanning line, and a drain of the ninth switching transistor is grounded; and a drain of the tenth switching transistor is grounded.

2. The array substrate according to claim 1, wherein the circulating unit comprises one red sub-pixel unit, one blue sub-pixel unit and two green sub-pixel units.

3. The array substrate according to claim 1, wherein the circulating unit comprises one red sub-pixel unit, one green sub-pixel unit, one blue sub-pixel unit and one white sub-pixel unit.

4. The array substrate according to claim 1, wherein the first sub-pixel circuit is connected to the first sub-pixel, and the second sub-pixel circuit is connected to the second sub-pixel; and the control unit is configured to control the first sub-pixel circuit to drive the first sub-pixel when the first frame picture is displayed, and to control the second sub-pixel circuit to drive the second sub-pixel when the second frame picture is displayed.

5. The array substrate according to claim 2, wherein the first sub-pixel circuit is connected to the first sub-pixel, and the second sub-pixel circuit is connected to the second sub-pixel; and the control unit is configured to control the first sub-pixel circuit to drive the first sub-pixel when the first frame picture is displayed, and to control the second sub-pixel circuit to drive the second sub-pixel when the second frame picture is displayed.

6. The array substrate according to claim 3, wherein the first sub-pixel circuit is connected to the first sub-pixel, and the second sub-pixel circuit is connected to the second sub-pixel; and the control unit is configured to control the first sub-pixel circuit to drive the first sub-pixel when the first frame picture is displayed, and to control the second sub-pixel circuit to drive the second sub-pixel when the second frame picture is displayed.

7. The array substrate according to claim 4, further comprising a plurality of data lines, and the first sub-pixel circuit and the second sub-pixel circuit in each pixel circuit are connected to the same data line.

8. The array substrate according to claim 5, further comprising a plurality of data lines, and the first sub-pixel circuit and the second sub-pixel circuit in each pixel circuit are connected to the same data line.

9. The array substrate according to claim 6, further comprising a plurality of data lines, and the first sub-pixel circuit and the second sub-pixel circuit in each pixel circuit are connected to the same data line.

10. A display panel, comprising the array substrate according to claim 1.

11. A display device, comprising the display panel according to claim 10.

12. A driving method of an array substrate, the array substrate comprising a plurality of circulating units and a plurality of pixel circuits, wherein each circulating unit consists of four sub-pixel units located in four columns and two rows, sub-pixel units in any two adjacent columns are located in different rows and have different colors, and sub-pixel units in at least one row have different colors:

each sub-pixel unit comprises a first sub-pixel and a second sub-pixel located in the same column and having the same color, and both the first sub-pixel and the second sub-pixel are connected to a same pixel circuit; and the pixel circuit is configured to drive the first sub-pixel when a first frame picture is displayed, and to drive the second sub-pixel when a second frame picture is displayed, wherein each pixel circuit of the plurality of pixel circuits comprises a first sub-pixel circuit and a second sub-pixel circuit, the first sub-pixel circuit comprises a first driving transistor and the second sub-pixel circuit comprises a second driving transistor, the first sub- pixel circuit and the second sub-pixel circuit share a compensation unit, and are controlled by a same data line, which is connected to a control unit; the compensation unit is configured to adjust a gate voltage of the first driving transistor in the first sub-pixel circuit to eliminate influence of a threshold voltage of the first driving transistor on a driving current of the first sub-pixel; and to adjust a gate voltage of the second driving transistor in the second sub-pixel circuit to eliminate influence of a threshold voltage of the second driving transistor on a driving current of the second sub-pixel; the compensation unit comprises a first switching transistor, a second switching transistor, a third switching transistor, a fourth switching transistor, a fifth switching transistor, a sixth switching transistor, a seventh switching transistor, an eighth switching transistor, a ninth switching transistor, a tenth switching transistor, a first storage capacitor and a second storage capacitor; a gate of the first switching transistor and a gate of the seventh switching transistor are connected to a first light emitting control line, a source of the first switching transistor is connected to a source of the second switching transistor and a first reference voltage source, and a drain of the first switching transistor is connected to a source of the fourth switching transistor and a source of the first driving transistor; a gate of the second switching transistor is connected to a gate of the eighth switching transistor and a second light emitting control line, and a drain of the second switching transistor is connected to a source of the fifth switching transistor and a source of the second switching transistor; a gate of the third switching transistor is connected to a gate of the fourth switching transistor and a first scanning line a source of the third switching transistor is connected to the data line, a drain of the third switching transistor is connected to a second terminal of the first storage capacitor and a source of the seventh switching transistor; a drain of the fourth switching transistor is connected to a first terminal of the first storage capacitor and a gate of the first driving transistor; a gate of the fifth switching transistor is connected to a gate of the sixth switching transistor and a second scanning line, and a drain of the fifth switching transistor is connected to a first terminal of the second storage capacitor and a gate of the second driving transistor; a source of the sixth switching transistor is connected to the data line, a drain of the sixth switching transistor is connected to a second terminal of the second storage capacitor and a source of the eighth switching transistor; a drain of the seventh switching transistor is connected to a source of the ninth switching transistor, a drain of the first driving transistor and a first terminal of the first sub-pixel, and a second terminal of the first sub-pixel is grounded; a drain of the eighth switching transistor is connected to a source of the tenth switching transistor, a drain of the second driving transistor and a first terminal of the second sub-pixel, and a second terminal of the second sub-pixel is grounded; a gate of the ninth switching transistor is connected to a gate of the tenth switching transistor and the second scanning line, and a drain of the ninth switching transistor is grounded; and a drain of the tenth switching transistor is grounded, the driving method comprising:

driving, by the pixel circuit, the first sub-pixel in the sub-pixel unit connected to the pixel circuit when a first frame picture is displayed; and driving, by the pixel circuit, the second sub-pixel in the sub-pixel unit connected to the pixel circuit when a second frame picture is displayed.

13. The driving method according to claim 12, wherein the circulating unit comprises one red sub-pixel unit, one blue sub-pixel unit and two green sub-pixel units.

14. The driving method according to claim 12, wherein the circulating unit comprises one red sub-pixel unit, one green sub-pixel unit, one blue sub-pixel unit and one white sub-pixel unit.

15. The driving method according to claim 12, wherein the first sub-pixel circuit is connected to the first sub-pixel, and the second sub-pixel circuit is connected to the second sub-pixel; and the control unit is configured to control the first sub-pixel circuit to drive the first sub-pixel when the first frame picture is displayed, and to control the second sub-pixel circuit to drive the second sub-pixel when the second frame picture is displayed.

16. The driving method according to claim 15, wherein the array substrate further comprises a plurality of data lines, and the first sub-pixel circuit and the second sub-pixel circuit in each pixel circuit are connected to the same data line.

* * * * *